US009025986B2

(12) United States Patent
Shiga et al.

(10) Patent No.: US 9,025,986 B2
(45) Date of Patent: May 5, 2015

(54) MOVING DEVICE ASSEMBLY AND IMAGE FORMING APPARATUS INCLUDING THE MOVING DEVICE ASSEMBLY

(71) Applicants: Yuuki Shiga, Hyogo (JP); Sei Onuma, Osaka (JP); Kozo Yamazaki, Hyogo (JP); Kimihiro Tanaka, Osaka (JP)

(72) Inventors: Yuuki Shiga, Hyogo (JP); Sei Onuma, Osaka (JP); Kozo Yamazaki, Hyogo (JP); Kimihiro Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/900,651

(22) Filed: May 23, 2013

(65) Prior Publication Data

US 2013/0322910 A1 Dec. 5, 2013

(30) Foreign Application Priority Data

Jun. 5, 2012 (JP) ..... 2012-128123
Oct. 15, 2012 (JP) ..... 2012-227939

(51) Int. Cl.

| | |
|---|---|
| ***G03G 15/00*** | (2006.01) |
| ***G03G 15/08*** | (2006.01) |
| ***G03G 21/16*** | (2006.01) |
| ***G03G 15/01*** | (2006.01) |

(52) U.S. Cl.

CPC ..... *G03G 15/0896* (2013.01); *G03G 21/1661* (2013.01); *G03G 15/5054* (2013.01); *G03G 15/0194* (2013.01); *G03G 21/168* (2013.01)

(58) Field of Classification Search

USPC ..... 399/49, 72, 74

See application file for complete search history.

(56) References Cited

U.S. PATENT DOCUMENTS

| | | | | |
|---|---|---|---|---|
| 4,853,710 | A | 8/1989 | Shimada et al. | |
| 6,151,057 | A | 11/2000 | Yamazaki et al. | |
| 8,055,145 | B2 * | 11/2011 | Tomita et al. | 399/74 |
| 2004/0184828 | A1 | 9/2004 | Bannai et al. | |
| 2004/0240905 | A1 | 12/2004 | Yamazaki | |
| 2005/0238388 | A1 | 10/2005 | Tanaka | |
| 2007/0246638 | A1 | 10/2007 | Idehara et al. | |
| 2008/0063425 | A1 | 3/2008 | Idehara et al. | |
| 2008/0226352 | A1 | 9/2008 | Tanaka et al. | |
| 2008/0226358 | A1 | 9/2008 | Hanashima et al. | |
| 2008/0253796 | A1 | 10/2008 | Idehara et al. | |
| 2008/0279585 | A1 | 11/2008 | Furuichi et al. | |
| 2008/0292356 | A1 | 11/2008 | Furuichi et al. | |
| 2009/0074446 | A1 | 3/2009 | Idehara et al. | |
| 2009/0074456 | A1 | 3/2009 | Tada et al. | |
| 2009/0074462 | A1 | 3/2009 | Yamazaki | |
| 2009/0080937 | A1 | 3/2009 | Kita et al. | |

(Continued)

FOREIGN PATENT DOCUMENTS

| | | |
|---|---|---|
| JP | 11-065397 | 3/1999 |
| JP | 2001-034032 | 2/2001 |

(Continued)

*Primary Examiner* — Hoang Ngo

(74) *Attorney, Agent, or Firm* — Oblon, McClelland, Maier & Neustadt, L.L.P.

(57) ABSTRACT

A moving device assembly includes a moving device and a shield. The moving device is movable between a first position and a second position, to move a detector including a detection surface relative to an opposing member disposed opposite the detector. The shield shields the detection surface of the detector. As the moving device is at the first position, the detector is at a proximal position at which the detector is near the opposing member, and as the moving device is at the second position, the detector is at a shield position at which the detector is separated from the opposing member and the detection surface of the detector is shielded by the shield.

19 Claims, 16 Drawing Sheets

(56) References Cited

U.S. PATENT DOCUMENTS

| | | | |
|---|---|---|---|
| 2009/0110432 | A1 | 4/2009 | Idehara et al. |
| 2009/0152435 | A1 | 6/2009 | Kondo et al. |
| 2009/0245822 | A1 | 10/2009 | Nagatsuka et al. |
| 2009/0285588 | A1 | 11/2009 | Furuichi et al. |
| 2009/0324263 | A1 | 12/2009 | Shimizu et al. |
| 2010/0061755 | A1 | 3/2010 | Furuichi et al. |
| 2010/0067942 | A1 | 3/2010 | Hagiwara et al. |
| 2010/0192710 | A9 | 8/2010 | Hanashima et al. |
| 2011/0052261 | A1 | 3/2011 | Fukushima et al. |
| 2011/0058847 | A1 | 3/2011 | Furuichi et al. |
| 2011/0062835 | A1 | 3/2011 | Idehara et al. |
| 2011/0064456 | A1 | 3/2011 | Tada et al. |
| 2011/0182614 | A1 | 7/2011 | Onuma et al. |
| 2011/0229197 | A1 | 9/2011 | Tada et al. |

FOREIGN PATENT DOCUMENTS

| | | |
|---|---|---|
| JP | 2004-184710 | 7/2004 |
| JP | 2005-070676 | 3/2005 |
| JP | 2007-225955 | 9/2007 |
| JP | 2008-286970 | 11/2008 |
| JP | 2010-002491 | 1/2010 |

* cited by examiner

MOVING DEVICE ASSEMBLY AND IMAGE FORMING APPARATUS INCLUDING THE MOVING DEVICE ASSEMBLY

CROSS-REFERENCE TO RELATED APPLICATIONS

This patent application is based on and claims priority pursuant to 35 U.S.C. §119 from Japanese Patent Application Nos. 2012-128123, filed on Jun. 5, 2012 and 2012-227939, filed on Oct. 15, 2012, both in the Japan Patent Office, which are hereby incorporated herein by reference in their entirety.

BACKGROUND

1. Technical Field

Exemplary aspects of the present invention generally relate to an image forming apparatus, such as a copier, a facsimile machine, a printer, or a multi-functional system including a combination thereof, and more particularly to, a moving device assembly that moves a detector toward and away from an opposing member such as an intermediate transfer belt employed in the image forming apparatus.

2. Description of the Related Art

Conventionally, known image forming apparatuses, such as a copier, a facsimile machine, a printer, and a multi-functional system including a combination thereof form test image patterns on a surface of an intermediate transfer member such as an intermediate transfer belt for detection of the density and the position of a toner image. Such image patterns are detected by a detector.

In order to enhance accuracy of the detector, the detector needs to be disposed near the surface of the intermediate transfer member on which the image patterns are formed. However, if the detector is disposed close to the intermediate transfer member, the surface of the intermediate transfer member may contact and damage a detection surface of the detector upon replacement of the intermediate transfer member.

In view of the above, there is known an image forming apparatus in which the detector is separated from the intermediate transfer member as necessary. Furthermore, in order to facilitate separation of the detector from the intermediate transfer member, the known image forming apparatus includes a moving device that moves the detector in conjunction with movement of a cover provided to the image forming apparatus.

Although advantageous, if the detection surface of the detector is exposed while the detector is separated from the intermediate transfer member and other components, the detection surface of the detector may easily come into contact with technicians replacing the intermediate transfer member and/or contaminated by foreign substances. Contamination of and damage to the detection surface of the detector degrade detection accuracy of the detector.

SUMMARY

In view of the foregoing, in an aspect of this disclosure, there is provided an improved moving device assembly including a moving device and a shield. The moving device is movable between a first position and a second position, to move a detector including a detection surface relative to an opposing member disposed opposite the detector. The shield shields the detection surface of the detector. As the moving device is at the first position, the detector is at a proximal position at which the detector is near the opposing member, and as the moving device is at the second position, the detector is at a shield position at which the detector is separated from the opposing member and the detection surface of the detector is shielded by the shield.

According to another aspect, a moving device assembly includes a moving device, a shaft, and a shield. The moving device is movable between a first position and a second position, to move a detector including a detection surface relative to an opposing member disposed opposite the detector. The shield shields the detection surface of the detector. As the moving device is moved from the first position to the second position, the detector is moved from a proximal position at which the detector is near the opposing member to a first retracted position at which the detector is separated from the opposing member and to a second retracted position at which the detector is separated from the opposing member and the detection surface of the detector is shielded by the shield by rotating the detector about the shaft.

According to another aspect, a moving device assembly includes a moving device and a shield. The moving device is movable between a first position and a second position, to move a first member including a detection surface relative to a second member disposed opposite the first member. The shield shields the detection surface of the first member. As the moving device is at the first position, the first member is at a proximal position at which the first member is near the second member, and as the moving device is at the second position, the first member is at a shield position at which the first member is separated from the second member and the detection surface of the first member is shielded by the shield.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
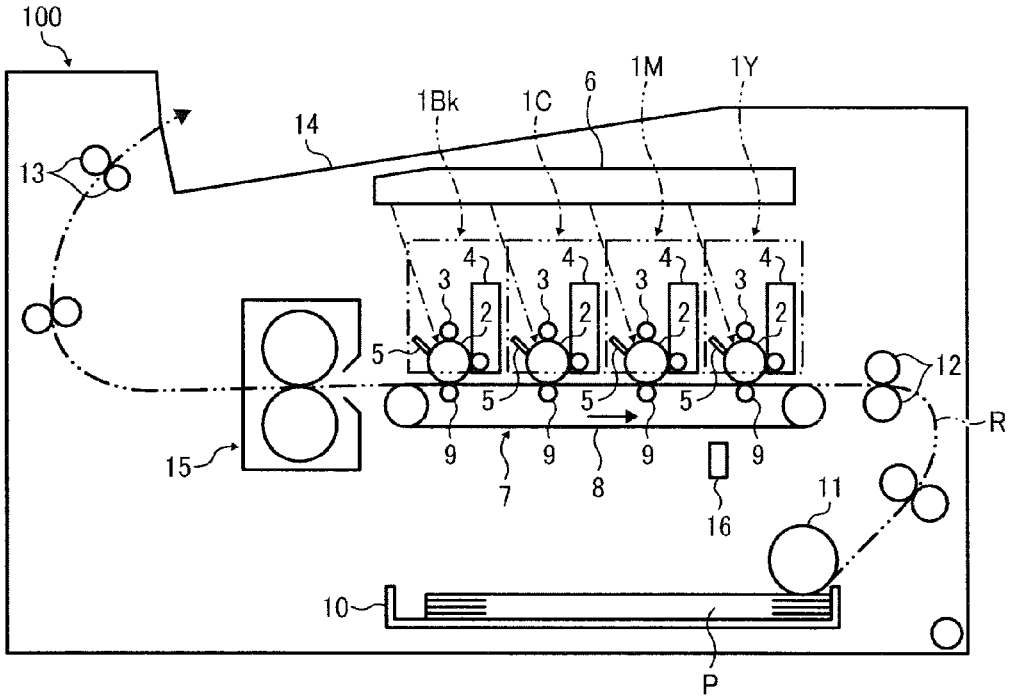
FIG. 1 is a schematic diagram illustrating a color laser printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color laser printer as an example of the image forming apparatus according to an illustrative embodiment of the present disclosure. As illustrated in FIG. 1, an image forming apparatus 100 includes four image forming units 1Y, 1M, 1C, and 1Bk, one for each of the primary colors yellow, magenta, cyan, and black are arranged in tandem facing a transfer device 7. Each of the image forming units 1Y, 1M, 1C, and 1Bk includes a photosensitive drum 2 serving as a latent image bearing member, a charging roller 3 serving as a charger, a developing device 4, a cleaning blade 5, and so forth. The charging roller 3 charges the surface of the photosensitive drum 2. The developing device 4 develops an electrostatic latent image on the photosensitive drum 2 with toner. The cleaning blade 5 serves as a cleaning device to clean the surface of the photosensitive drum 2.

It is to be noted that the suffixes Y, C, M, and Bk denote colors yellow, cyan, magenta, and black, respectively, and to simplify the description, these suffixes are omitted herein unless otherwise specified. The image forming units 1Y, 1M, 1C, and 1Bk all have the same configuration, differing only in the color of toner employed.

In FIG. 1, an exposure device 6 is disposed above the image forming units 1Y, 1M, 1C, and 1Bk. The exposure device 6 forms an electrostatic latent image on each of the surfaces of the photosensitive drums 2 of the image forming units 1Y, 1M, 1C, and 1Bk.

The exposure device 6 includes a light source, a polygon mirror, an f-θ lens, a reflective mirror, and so forth, and illuminates the surfaces of the photosensitive drums 2 with laser light based on image data.

The transfer device 7 serving as a transfer mechanism to transfer a toner image onto a recording medium P is disposed below the image forming units 1Y, 1M, 1C, and 1Bk. The transfer device 7 includes a conveyor belt 8 formed into an endless loop and four transfer rollers 9 disposed inside the looped conveyor belt 8, each facing the photosensitive drums 2. The conveyor belt 8 carries and delivers a recording medium P. The conveyor belt 8 is entrained around and stretched taut by a plurality of support rollers at a predetermined tension.

One of the support rollers serves as a driving roller that rotates, thereby rotating the conveyor belt 8 in the direction of arrow in FIG. 1. Each of four transfer rollers 9 contacts the photosensitive drum 2 via the conveyor belt 8 so that the photosensitive drums 2 and the conveyor belt 8 contact, thereby forming a transfer nip therebetween at which the toner image is transferred onto the recording medium. The transfer rollers 9 are connected to a power source and supplied with a certain direct current (DC) voltage and an alternating current (AC) voltage.

A sheet tray 10 storing a stack of recording media P, a sheet feed roller 11, and so forth are disposed at the bottom of the image forming apparatus 100. The recording medium P includes, but is not limited to, thick paper, postcards, envelopes, normal paper, thin paper, coated paper such as coated paper and art paper, and tracing paper. As a recording medium P, an OHP sheet and an OHP film may be used.

In the image forming apparatus 100, the recording medium P fed from the sheet tray 10 is delivered to the transfer nips in the image forming units 1Y, 1M, 1C, and 1Bk, and discharged outside the image forming apparatus 100 via a sheet path R. Upstream from the image forming units 1Y, 1M, 1C, and 1Bk in the sheet path R in the direction of sheet delivery, there is provided a pair of registration rollers 12 serving as timing rollers. Downstream from the image forming units 1Y, 1M, 1C, and 1Bk in the direction of sheet delivery is a fixing device 15 to fix an unfixed toner image transferred on the recording medium P. A pair of sheet output rollers 13 is disposed at the downstream end of the sheet path R in the sheet delivery direction. The pair of sheet output roller 13 outputs the recording medium P outside the image forming apparatus 100, onto a sheet output tray 14 disposed at the upper surface of the image forming apparatus 100. Multiple recording media can be stacked on the sheet output tray 14.

A pattern detector 16 is disposed outside the looped conveyor belt 8, facing the outer circumferential surface of the conveyor belt 8. The pattern detector 16 is a reflective type optical sensor that detects an image pattern to detect an image density and a positional deviation of an image formed on the conveyor belt 8.

With reference to FIG. 1, a description is provided of a basic operation of the image forming apparatus 100 according to another illustrative embodiment of the present disclosure.

When an image forming operation is started, the photosensitive drums 2 in the image forming units 1Y, 1M, 1C, and 1Bk are rotated in the clockwise direction by a drive device and charged uniformly with a predetermined polarity by the charging rollers 3. Subsequently, based on image information of a document read by an image reading device, the charged surfaces of the photosensitive drums 2 are illuminated with laser light projected from the exposure device 6. Accordingly, electrostatic latent images are formed on the surfaces of the photosensitive drums 2. More specifically, upon exposure of the photosensitive drums 2, the image information is separated into individual color components, yellow, magenta, cyan, and black, and laser light based on single color information thus obtained is illuminated. The electrostatic latent images on the photosensitive drums 2 are developed with respective color of toner by the developing devices 4 into visible images, known as toner images.

Upon start of the image forming operation, the conveyor belt 8 starts to rotate in the direction of arrow in FIG. 1, and the transfer rollers 9 are supplied with a voltage having the polarity opposite the charge polarity of the toner, thereby forming a transfer electric field in the transfer nips defined by the conveyor belt surface and the photosensitive drums 2. Here, the voltage is either under constant voltage control or constant current control.

In the meantime, the sheet feed roller 11 starts to rotate, picking up a top sheet of the stack of recording media P and feeding it to the sheet path R. The recording medium P sent to the sheet path R is sent to the conveyor belt 8 by the pair of registration rollers 12 at appropriate timing.

As the recording medium P is carried on the surface of the conveyor belt 8 and passes through the transfer nips while the conveyor belt 8 rotates, the toner images on the photosensitive drums 2 are transferred onto the recording medium P due to the transfer electric field formed in the transfer nips so that the toner images are superimposed one atop the other, thereby forming a composite (full-color) toner image.

Residual toner, not having been transferred, thus remaining on the photosensitive drums 2 are removed by the cleaning blades 5. Subsequently, residual charge remaining on the surface of the photosensitive drums 2 is removed and initialized by a charge remover in preparation for the subsequent imaging cycle.

After the composite toner image is transferred onto the recording medium P, the recording medium P is transported to the fixing device 15 in which heat and pressure are applied to the recording medium P, thereby fixing the composite toner image on the recording medium P. After the toner image is fixed on the recording medium P, the recording medium P is output onto the sheet output tray 14 by the sheet discharge rollers 13.

The above description pertains to an image forming operation for forming a multiple-color image on a recording medium P. However, the image forming operation is not limited thereto. The image forming apparatus may form a single-color image using one of image forming units 1Y, 1M, 1C, and 1Bk, or two or three-color image using two or three image forming units.

The image forming units 1Y, 1M, 1C, and 1Bk serve as pattern image forming devices for forming test image patters for detection on the conveyor belt 8 when adjusting the density and positional deviations of each toner image. More specifically, the image patterns for detection and adjustment of the image density and positional deviations are formed on the photosensitive drums 2 of the image forming units 1Y, 1M, 1C, and 1Bk, and transferred onto the conveyor belt 8 at the transfer nips in the similar manner as the image formation and transfer operation described above.

Figure 2:
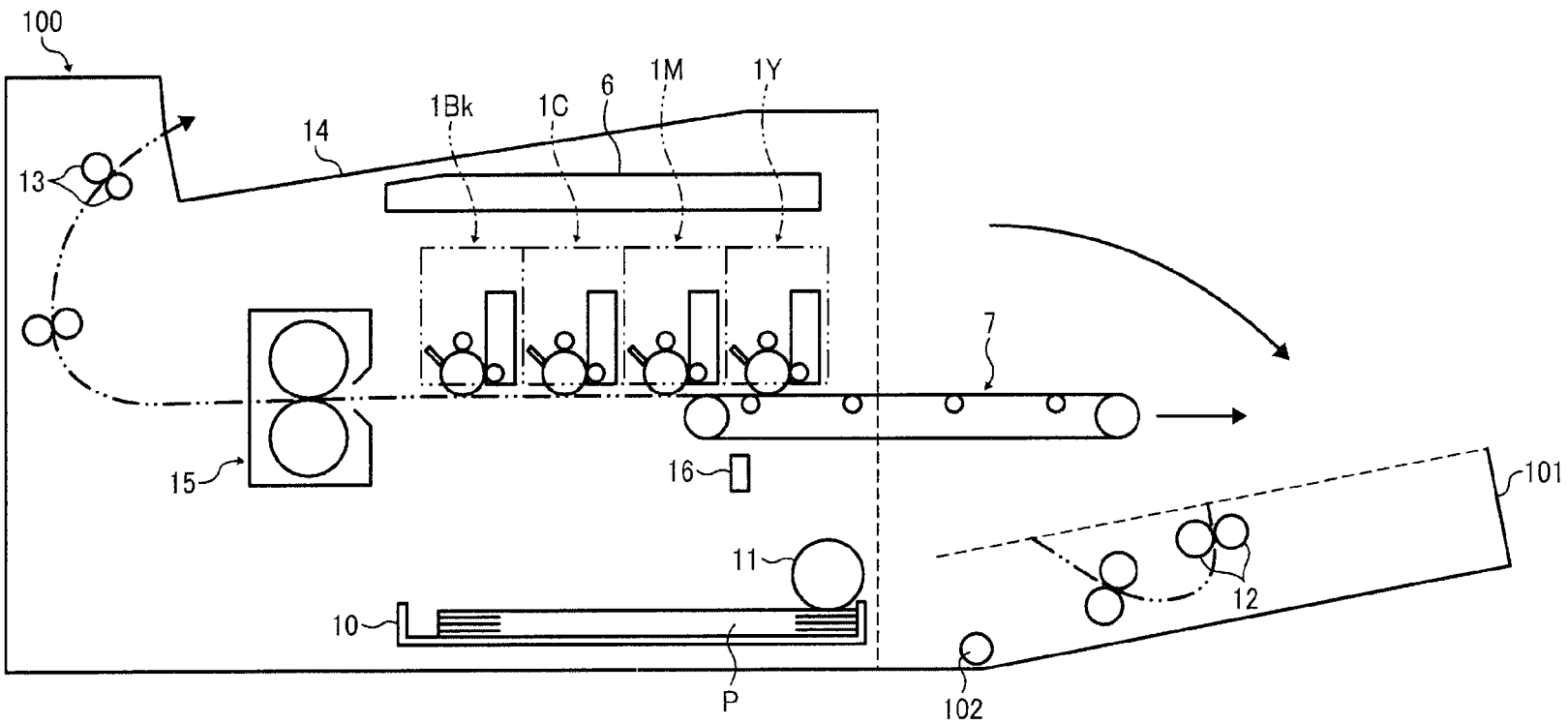
FIG. 2 is a schematic diagram illustrating the image forming apparatus from which a transfer device is being removed.

With reference to FIG. 2, a description is provided of installation and removal of the transfer device 7 relative to the image forming apparatus 100. FIG. 2 is a schematic diagram illustrating the image forming apparatus 100 and the transfer device 7. As illustrated in FIG. 2, the transfer device 7 is movable in the horizontal direction. A cover 101 is provided to the front (the right hand side in FIG. 2) of the image forming apparatus 100 and pivotally movable about a fulcrum 102 to open and close the image forming apparatus 100. With the cover 101 opened, the pair of registration rollers 12 and so forth separate from the front of the transfer device 7 together with the cover 101, thereby allowing the transfer device 7 to move in the horizontal direction and be removed from the image forming apparatus 100.

The pattern detector 16 is not detachable together with the transfer device 7. Upon removal of the transfer device 7, the pattern detector 16 remains in the image forming apparatus 100. In other words, the pattern detector 16 is movably disposed relative to the transfer device 7 to prevent the pattern detector 16 from coming into contact with the transfer device 7 when removing the transfer device 7 from the image forming apparatus 100.

With reference to FIGS. 3 through 6, a description is provided of a moving mechanism of the pattern detector 16 according to an illustrative embodiment of the present disclosure.

Figure 3:
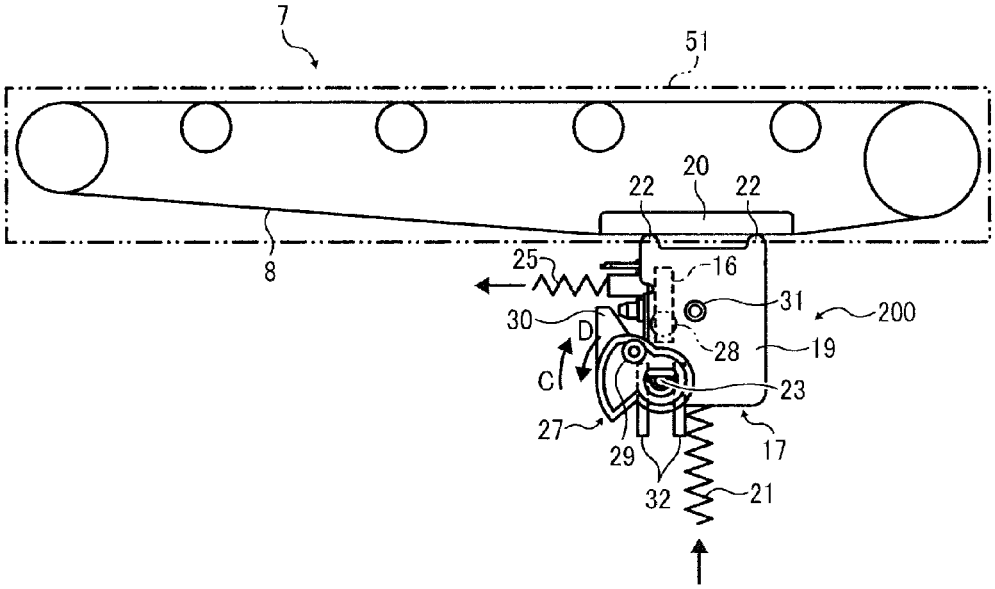
FIG. 3 is a partially enlarged side view schematically illustrating the transfer device and a moving device assembly employed in the image forming apparatus according to an illustrative embodiment of the present disclosure.
Figure 4:
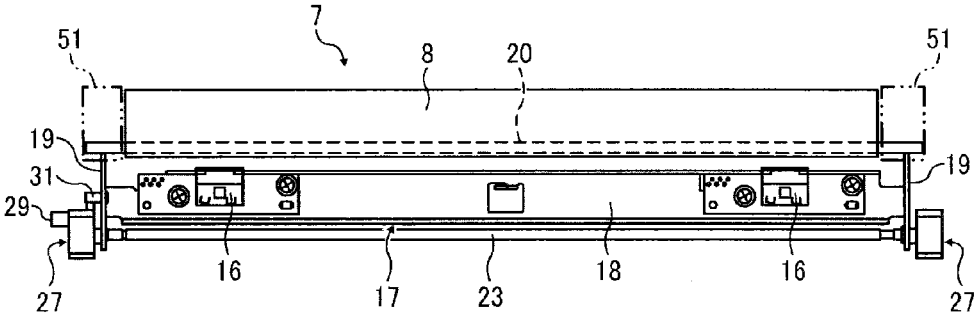
FIG. 4 is an elevational view schematically illustrating the transfer device and the moving device assembly.
Figure 5:
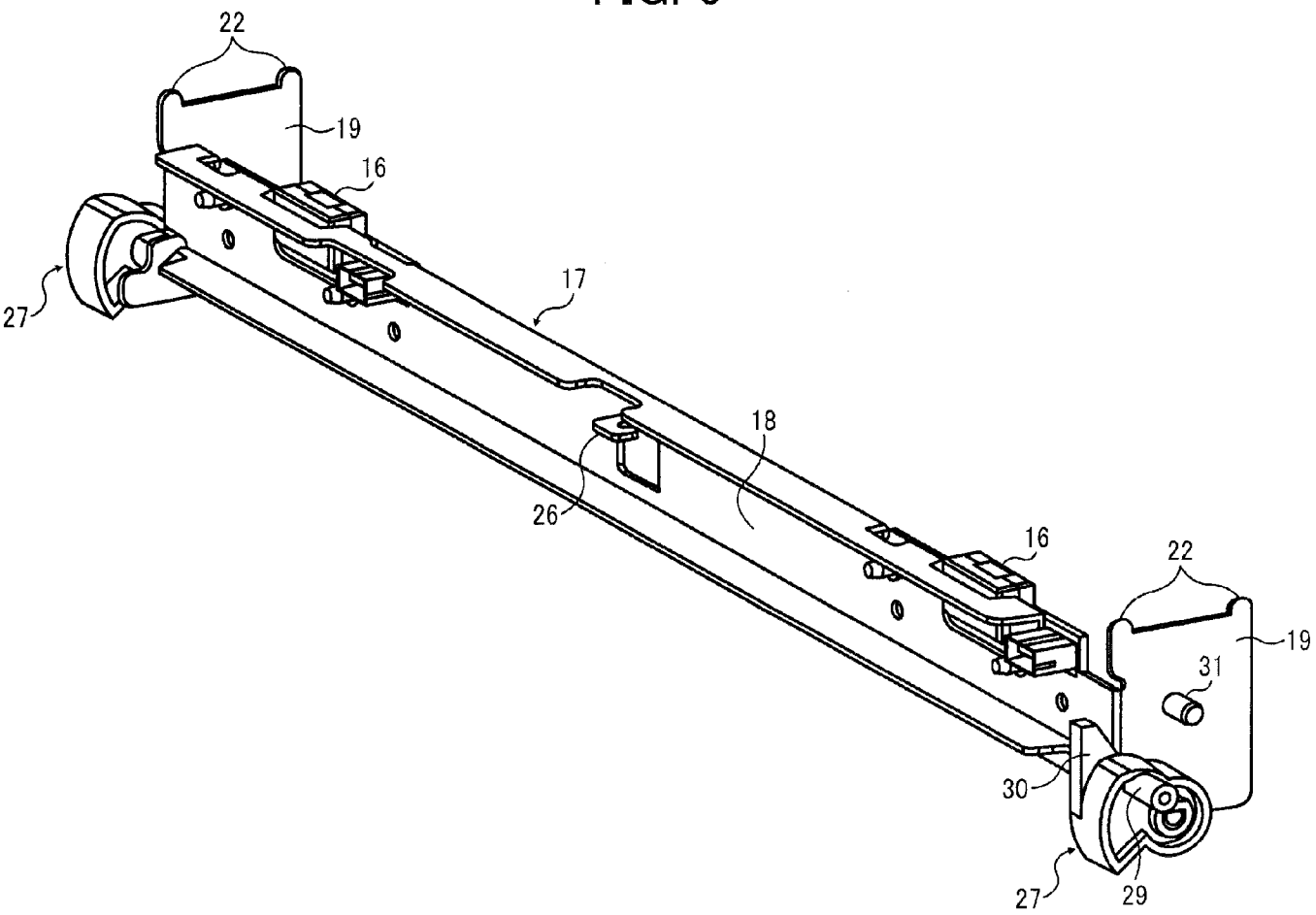
FIG. 5 is a perspective view schematically illustrating the moving device assembly as viewed from a diagonal back of the moving device assembly.
Figure 6:
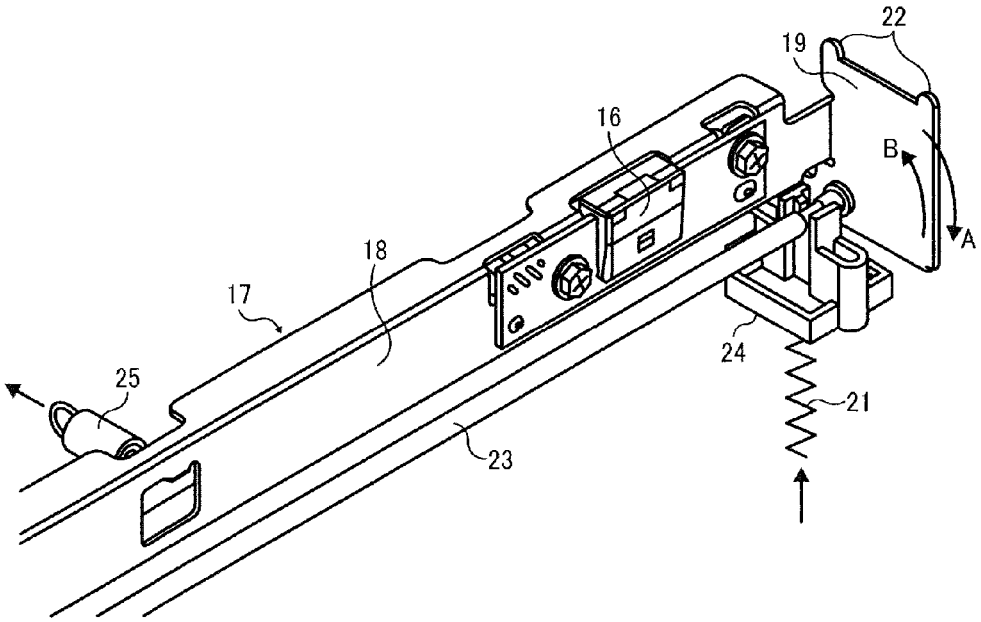
FIG. 6 is a perspective view schematically illustrating the moving device assembly as viewed from a diagonal front of the moving device assembly.

FIG. 3 is a partially enlarged side view schematically illustrating the transfer device 7 and a moving device assembly 200 for moving the pattern detector 16 employed in the image forming apparatus 100 according to an illustrative embodiment of the present disclosure. FIG. 4 is an elevational view schematically illustrating the transfer device 7 and the moving device assembly 200. FIG. 5 is a perspective view schematically illustrating the moving device assembly 200 as viewed from the diagonal back of the moving device assembly 200. FIG. 6 is a perspective view schematically illustrating the moving device assembly 200 as viewed from the diagonal front of the moving device assembly 200. It is to be noted that FIGS. 3 and 4 illustrate the transfer device 7 in an installed state in which the transfer device 7 is installed in the image forming apparatus 100 and the pattern detector 16 is positioned in place with respect to the transfer device 7.

According to the present illustrative embodiment, as illustrated in FIG. 3, the moving device assembly 200 that moves the pattern detector 16 toward and away from the transfer device 7 includes a compression spring 21, a cam follower 28, and a cam 27. The compression spring 21 serves as a biasing member to bias the pattern detector 16 against the conveyor belt 8. The cam follower 28 is fixed to a component other than the pattern detector 16 (i.e., a frame of the image forming apparatus). The cam 27 slidably contacts the cam follower 28 so as to separate the pattern detector 16 from the conveyer belt 8 against the force of the compression spring 21.

More specifically, the pattern detector 16 is held by a retainer 17. The compression spring 21 presses the retainer 17 against the conveyor belt 8 in the direction of arrow in FIG. 3. The cam 27 is rotatably attached to the retainer 17 via a shaft 23 disposed in the horizontal direction. As the cam 27 rotates about the shaft 23, the cam 27 slidably contacts the cam follower 28, moving the retainer 17 downwards in FIG. 3 against the force of the compression spring 21.

As illustrated in FIG. 4, the retainer 17 includes a detector mount 18 and a pair of lateral plates 19. The detector mount 18 extends in the width direction of the conveyor belt 8. Each lateral plate 19 is disposed at both ends of the detector mount 18 in the longitudinal direction thereof. According to the present illustrative embodiment, two pattern detectors 16 are attached to the detector mount 18. The number of the pattern detectors 16 is not limited to two.

As illustrated in FIG. 3, a belt support 20 is provided to the conveyor belt 8 at the position opposite the pattern detectors 16 to support the inner circumferential surface of the conveyor belt 8, that is, an opposed surface of the surface facing the pattern detectors 16. The belt support 20 is attached to a pair of frames 51 of the transfer device 7. The support rollers for supporting the transfer roller 9 and the conveyor belt 8 are rotatably attached also to the pair of frames 51.

As illustrated in FIG. 4, the belt support 20 extends over the width direction of the conveyor belt 8, and both ends thereof project beyond the end of the conveyor belt 8 in the width direction thereof. Both ends of the belt support 20 projecting beyond the conveyor belt 8 contact the lateral plates 19, thereby positioning the pattern detector 16 in place relative to the conveyor belt 8. More specifically, the compression spring 21 shown in FIG. 3 presses the retainer 17 against the belt support 20, causing projections 22 (in this example, two projections 22) provided to the upper surface of the lateral plates 19 to contact the bottom surface of the belt support 20. Accordingly, the retainer 17 is positioned in place.

According to the present illustrative embodiment, the retainer 17 contacts the belt support 20 to position the pattern detector 16 in place. Alternatively, the retainer 17 may contact the frames 51 of the transfer device 7 to position the pattern detector 16 in place. Preferably, the retainer 17 contacts the belt support 20 because the relative positions of the pattern detector 16 and the conveyor belt 8 are maintained more precisely.

In a case in which there is space above the retainer 17 to accommodate a biasing member, a tension spring may be employed, instead of the compression spring. In other words, one end of the tension spring is attached to the retainer 17, and the other end of the tension spring is attached to the frame of the image forming apparatus 100. In this configuration, the retainer 17 can be biased toward the belt support 20.

As illustrated in FIG. 4, the retainer 17 is rotatably supported by the shaft 23 serving as a support member. Both ends of the shaft 23 penetrate through holes formed in the pair of lateral plates 19 of the retainer 17. The shaft 23 and the retainer 17 are rotatable relative to each other.

As illustrated in FIG. 6, a spring bearing 24 to receive the compression spring 21 is provided to both ends of the shaft 23. The spring bearing 24 is rotatably attached relatively to the shaft 23 so that even when the shaft 23 rotates, the spring bearing 24 does not rotate, thereby reliably receiving pressure from the compression spring 21.

As illustrated in FIG. 6, a tension spring 25 serving as a biasing member is attached to the back of the retainer 17. One end of the tension spring 25 is hooked to an engaging portion 26 disposed substantially at the center of the detector mount 18 in the longitudinal direction thereof shown in FIG. 5. The other end thereof is attached to an engaging portion provided to the frame or the main body of the image forming apparatus 100. The retainer 17 is biased toward the back by the tension spring 25. In a case in which the retainer 17 rotates in a direction of arrow A in FIG. 6 and tilts forward, the tension spring 25 pulls the retainer 17, causing the retainer 17 to rotate in a direction of arrow B, back to its original position. Instead of using the tension spring 25, a compression spring may be employed to push the retainer 17 in the same direction described above.

As illustrated in FIG. 5, the cam 27 is provided to both ends of the shaft 23. Both ends of the shaft 23 have a D-shaped cross-section, and the cams 27 include a D-shaped hole. The D-shaped ends of the shaft 23 are fitted into the D-shaped holes of the cams 27, thereby enabling the shaft 23 and the cams 27 to rotate together.

According to the present illustrative embodiment, the cam 27 and the cam follower 28 are provided to both ends of the shaft 23, thereby moving more reliably the pattern detectors 16 as compared with providing the cam 27 and the cam follower 28 at one end of the shaft 23. According to the present illustrative embodiment, the cams 27 and the retainer 17 are connected via the shaft 23, and rotate about the shaft 23. In this configuration, separate rotation shafts for the cams 27 and the retainer 17 are not needed, thereby reducing the size of the apparatus.

Furthermore, the cams 27 rotate in conjunction with movement of the cover 101. According to the present illustrative embodiment, as illustrated in FIG. 5, one of the cams 27 includes a connector 29 projecting therefrom to connect to an interlocking member that moves in sync with movement (opening and closing) of the cover 101. As described above, two cams 27 are integrally connected via the shaft 23. In this configuration, when one of the cams 27 is rotated by the interlocking member, the other cam 27 rotates as well. In this state, when the cover 101 is opened, the cams 27 rotate in the direction of arrow C in FIG. 3. When the cover 101 is closed, the cams 27 rotate in the direction of arrow D in FIG. 3.

In the present illustrative embodiment, the connector 29 is provided to one of two cams 27. Alternatively, the connector 29 may be provided to both cams 27, thereby rotating both cams 27 in conjunction with movement of the cover 101.

Figure 7:
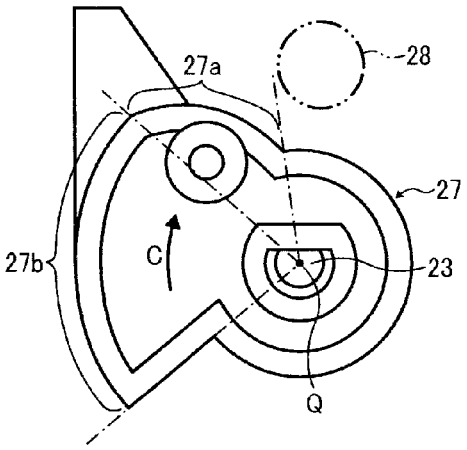
FIG. 7 is an enlarged view schematically illustrating a cam according to an illustrative embodiment of the present disclosure.

With reference to FIG. 7, a description is provided of the cam 27. FIG. 7 is an enlarged diagram schematically illustrating the cam 27. As illustrated in FIG. 7, the cam 27 includes a first cam surface 27*a* and a second cam surface 27*b*, both of which contact the cam follower 28. More specifically, a distance between a center Q of rotation of the cam 27 and the first cam surface 27*a* increases gradually toward an opposite direction of the direction of rotation of the cover 101 indicated by arrow C when the cover 101 is opened. The second cam surface 27*b* is continuously formed from the first cam surface 27*a* where the distance between the center Q of rotation of the cam 27 and the first cam surface 27*a* is at its maximum, and the distance between the center Q of rotation of the cam 27 and the second cam surface 27*b* does not change.

As illustrated in FIG. 5, the cam 27 includes a tab 30 serving as a contact member projecting therefrom. The tab 30 and the cam 27 are constituted as a single integrated member. The lateral plate 19 of the retainer 17 includes a projection 31 serving as a contact target that the tab 30 comes into contact with. As the tab 30 rotates with the cam 27, the tab 30 comes in contact with the projection 31. According to the present illustrative embodiment, the tab 30 is provided to one of the cams 27, and the projection 31 is provided to one of the lateral plates 19. Alternatively, the tab 30 may be provided to both cams 27, and the projection 31 is provided to both lateral plates 19.

As illustrated in FIG. 3, the image forming apparatus 100 includes a pair of guide members 32 for guiding the retainer 17. The pair of guide members 32 extends vertically so as to interpose the shaft 23 therebetween. As the shaft 23 moves along the pair of guide members 32, the retainer 17 is reliably guided to and away from the conveyor belt 8.

Figure 8A:
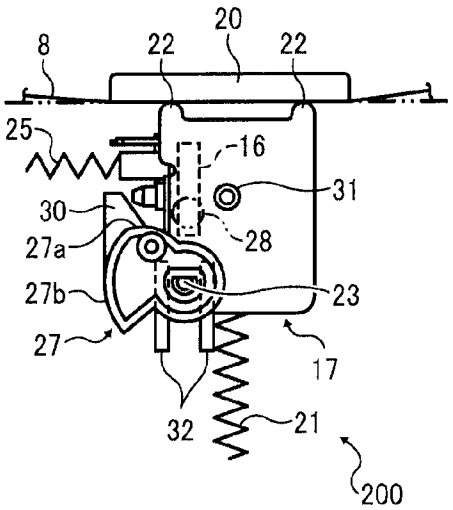
FIGS. 8A through 8C are schematic diagrams illustrating movement of a detector moved by the moving device assembly.
Figure 8B:
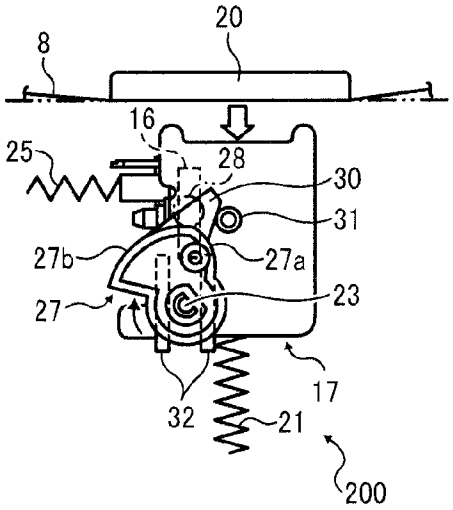
Figure 8C:
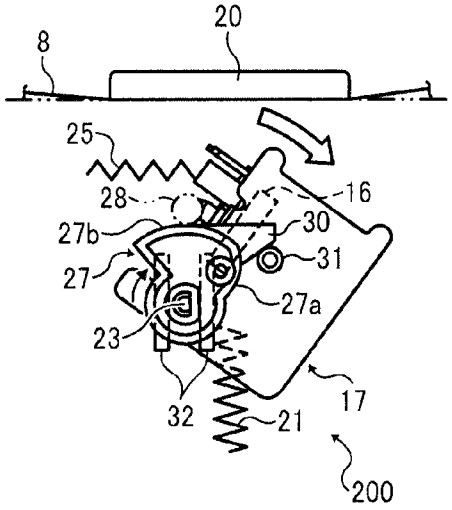

Next, with reference to FIGS. 8A through 8C, a description is provided of movement of the pattern detector 16.

In the state shown in FIG. 8A, the projections 22 of the retainer 17 contact the bottom surface of the belt support 20, and the pattern detector 16 is disposed near the conveyor belt 8. In other words, the pattern detector 16 is positioned at a place at which the pattern detector 16 can detect the image patterns on the conveyor belt 8. The cover 101 is closed in this state shown in FIG. 8A.

Upon replacing the transfer device 7, when the cover 101 is pivotally moved in an opening direction in which the cover 101 is opened from the state shown in FIG. 8A, the cams 27 move in the clockwise direction as shown in FIG. 8B in conjunction with the movement of the cover 101, and slidably contact the cam followers 28.

First, the first cam surface 27*a* starts to slidably contact the cam follower 28. The first cam surface 27*a* slidably contacts the cam follower 28 such that the distance between the center Q of rotation of the cam 27 and the cam surface increases gradually. As a result, the space between the center of rotation of the cam 27 and the cam follower 28 is widened against the force of the compression spring 21. Accordingly, as illustrated in FIG. 8B, the retainer 17 is pressed down, moving the pattern detector 16 to a first retracted position at which the pattern detector 16 is separated from the conveyor belt 8 in the direction perpendicular to the surface of the conveyor belt 8.

Subsequently, as illustrated in FIG. 8C, the second cam surface 27*b* starts to slidably contact the cam follower 28. Accordingly, the tab 30 contacts the projection 31, pushing the projection 31 in the rotation direction. As a result, the retainer 17 rotates about the shaft 23 in the clockwise direction in FIG. 8C and is held in the state in which the retainer 17 tilts forward. Accordingly, the pattern detector 16 is positioned at a second retracted position.

According to the present illustrative embodiment, as the cover 101 is opened, the pattern detector 16 near the transfer device 7 is moved from its detection position (i.e., near the transfer device 7, hereinafter referred to as a proximal position) to the first retracted position, and then continuously to the second retracted position by rotating the pattern detector 16 at the first retracted position. With this configuration, upon installation and removal of the transfer device 7, the transfer device 7 is prevented from contacting the pattern detector 16, hence preventing damage to the parts.

Figure 9:
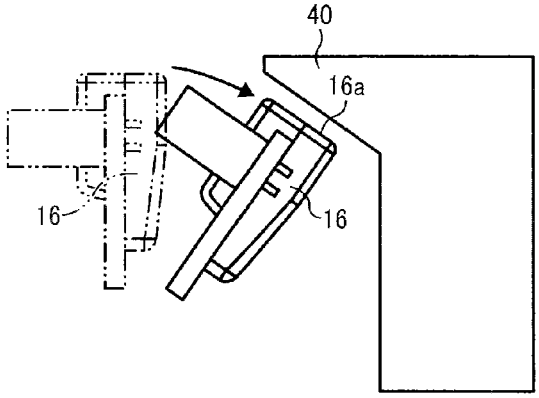
FIG. 9 is a schematic diagram illustrating a shield according to an illustrative embodiment of the present disclosure.

As illustrated in FIG. 9, the place to which pattern detector 16 is moved as the retainer 17 rotates tilting forward includes a shield 40 disposed on the frame 100. When the retainer 17 rotates such that the retainer 17 tilts forward and the pattern detector 16 is moved to the second retracted position, a detection surface 16*a* of the pattern detector 16 faces the shield 40 at a shield position so that the detection surface 16*a* is covered with the shield 40. With this configuration, the detection surface 16*a* is protected by the shield 40 from contamination upon installation and removal of the transfer device 7 by users or technicians while protecting from damage. Hence, optimum detection accuracy of the pattern detector 16 can be maintained reliably, thereby preventing degradation of image quality.

Next, a description is provided of movement of the moving device assembly 200 associated with closure of the cover 101.

As the cover 101 is pivotally moved to close after replacement of the transfer device 7 is completed, the cam 27 in the state shown in FIG. 8C rotates in the counterclockwise direction (i.e., in the opposite direction of the opening direction), and the second cam surface 27*b* slidably contacts the cam follower 28. In conjunction with rotation of the cam 27, the tab 30 also rotates in the counterclockwise direction in FIG. 8C. Because the tab 30 rotates in the direction in which the tab 30 does not press the projection 31, tension of the tension spring 25 causes the retainer 17 to rotate about the shaft 23 in the counterclockwise direction, returning to the state shown in FIG. 8B.

As the cam 27 rotates in the counterclockwise direction from the state shown in FIG. 8B, the first cam surface 27*a* slidably contacts the cam follower 28. As opposed to opening the cover 101, in this state, because the first cam surface 27*a* contacts the cam follower 28 such that the distance between the center Q of rotation of the cam 27 and the cam surface decreases gradually, combined with pressure of the compression spring 21, the space between the center of rotation of the cam 27 and the cam follower 28 is reduced. As a result, as illustrated in FIG. 8A, the retainer 17 is pushed up and the projections 22 of the retainer 17 contact the bottom surface of the belt support 20, thereby positioning the pattern detector 16 at the detection position. More specifically, in the present illustrative embodiment, the retainer 17 contacts the belt support 20 to position the pattern detector 16 in place, thereby enhancing positioning accuracy.

According to the present illustrative embodiment, a series of movement associated with closure of the cover 101 described above enables the pattern detector 16 to rotate and return from the second retracted position (the shield position) to the first retracted position, and furthermore, from the first retracted position to the vicinity of the transfer device 7, hence returning to the detection position (the proximal position).

Figure 10:
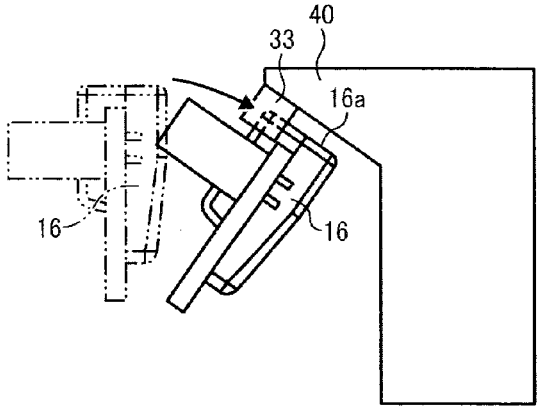
FIG. 10 is a schematic diagram illustrating a cleaning device according to an illustrative embodiment of the present disclosure.

As illustrated in FIG. 10, the shield 40 may be equipped with a cleaning member 33 serving as a cleaning device. The cleaning member 33 is made of, for example, flexible or soft material such as a sponge and a brush. As the pattern detector 16 moves to the second retracted position and the detection surface 16*a* of the pattern detector 16 contacts the cleaning member 33, the cleaning member 33 cleans the surface of the detection surface 16*a*. With this configuration, even when the detection surface 16*a* is contaminated, the detection surface 16*a* is cleaned by the cleaning member 33, thereby preventing degradation of image quality caused by contamination of the detection surface 16*a*.

Preferably, the cleaning member 33 is made of material that charges the detection surface 16*a* of the pattern detector 16 to the same polarity as the charge polarity of toner when contacting the detection surface 16*a*. In this case, repulsive force against the toner is generated on the detection surface 16*a* after cleaning so that the toner is repelled by the detection surface 16*a* and hence prevented from sticking thereto. The detection surface 16*a* is protected from contamination more reliably.

According to the present illustrative embodiment, opening of the cover 101 is not limited to the time when the transfer device 7 is replaced. For example, the cover 101 may be opened upon replacement of a waste toner bin and removal of jammed paper in the image forming apparatus. In a case in which the cover 101 is allowed to be opened and closed for a variety of reasons, the number of the opening and closure of the cover 101 increases, hence increasing the number of cleaning of the pattern detector 16. In this configuration, contamination and damage to the detection surface 16*a* of the pattern detector 16 are prevented more effectively, hence preventing degradation of image quality.

Figure 11:
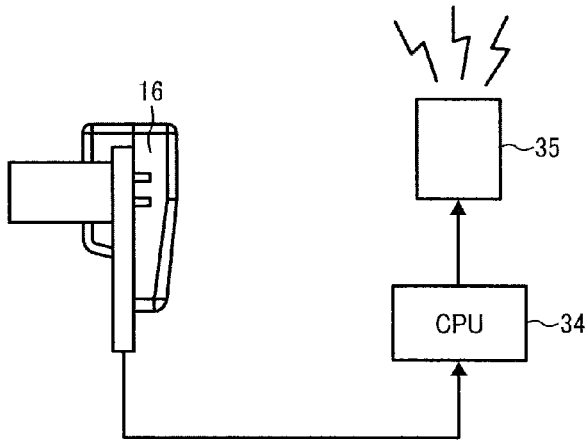
FIG. 11 is a schematic diagram illustrating a contamination detector and a reporting device according to an illustrative embodiment of the present disclosure.

Furthermore, as illustrated in FIG. 11, the image forming apparatus may include a contamination detector 34 for detecting contamination of the pattern detector 16 and a reporting device 35 to notify users of the contamination detected by the contamination detector 34. The contamination detector 34 is, for example, a central processing unit (CPU) provided to the image forming apparatus, and detects contamination of the pattern detector 16 by comparing an intensity (output value) of a signal provided by the pattern detector 16 with a predetermined threshold value. The reporting device 35 includes, but is not limited to, a display panel of the image forming apparatus that reports contamination by graphic or textual display, a light source that flashes light, and a speaker that reports contamination using sound.

With this configuration, when the pattern detector 16 is contaminated, users, technicians, and the like are notified of contamination and encouraged to clean the pattern detector 16 (to open the cover 101), thereby keeping the pattern detector 16 clean.

Figure 12:
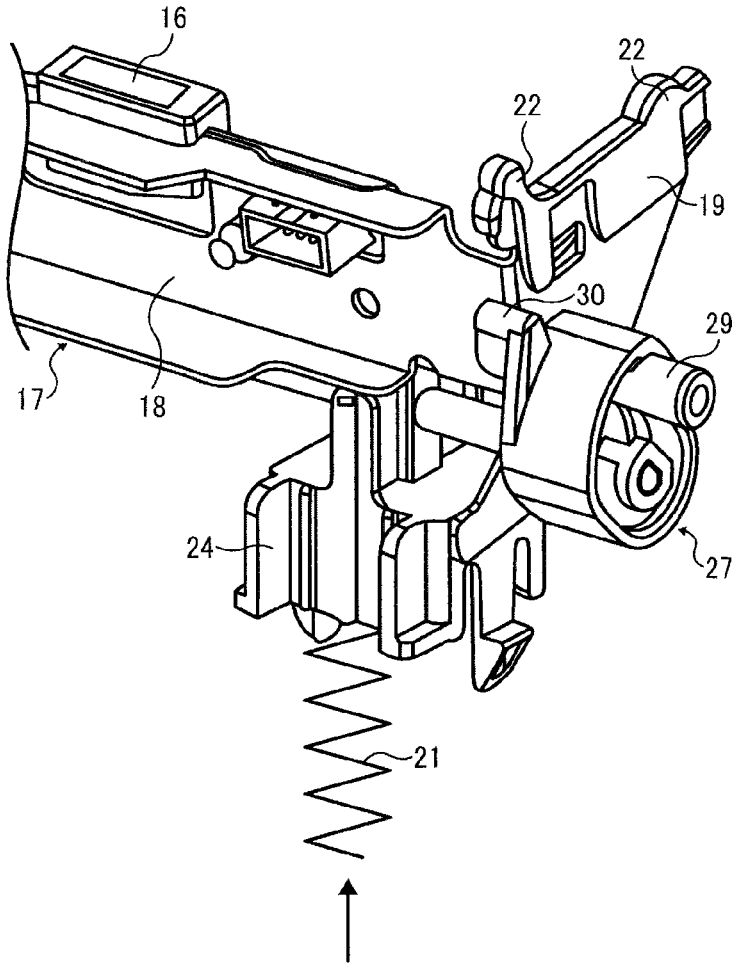
FIG. 12 is a schematic diagram illustrating a moving device assembly according to another illustrative embodiment.

With reference to FIG. 12, a description is provided of the moving device assembly according to another illustrative embodiment of the present disclosure. FIG. 12 is a schematic diagram illustrating another example of the moving device assembly.

According to the foregoing embodiment illustrated in FIGS. 8A through 8C, the lateral plate 19 of the retainer 17 includes the projection 31 that the tab 30 of the cam 27 contacts. By contrast, in the example shown in FIG. 12, the lateral plate 19 does not include the projection 31. In this configuration, as the tab 30 projecting from the cam 27 rotates together with the cam 27, the tab 30 contacts directly the back of the retainer 17. In other words, the back surface of the retainer 17 serves as a contact target that the tab 30 comes into contact with. Except the configuration of the retainer 17 described above, the configuration of the moving device assembly is the same as the foregoing embodiment, and the description thereof is omitted.

Figure 13A:
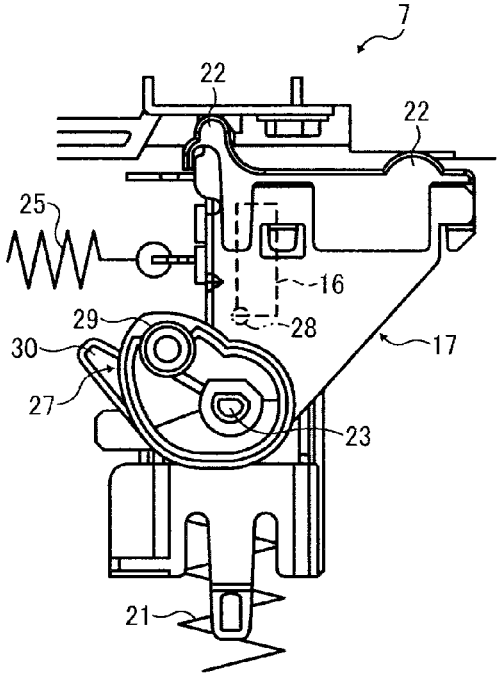
FIGS. 13A through 13C are schematic diagrams illustrating movement of the detector using the moving device assembly of FIG. 12.
Figure 13B:
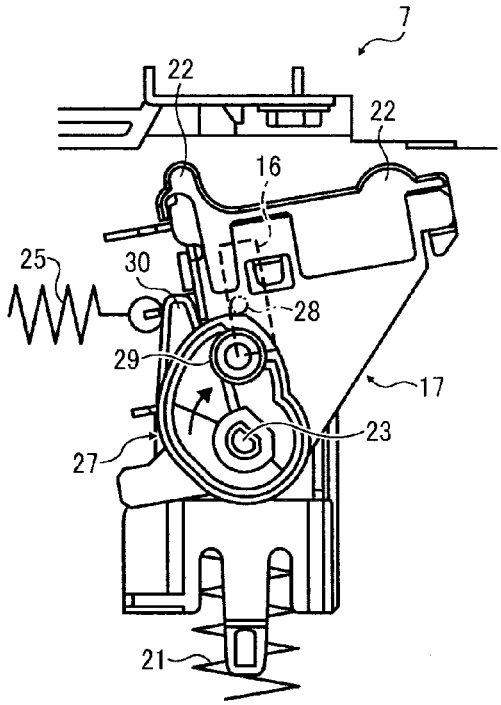
Figure 13C:
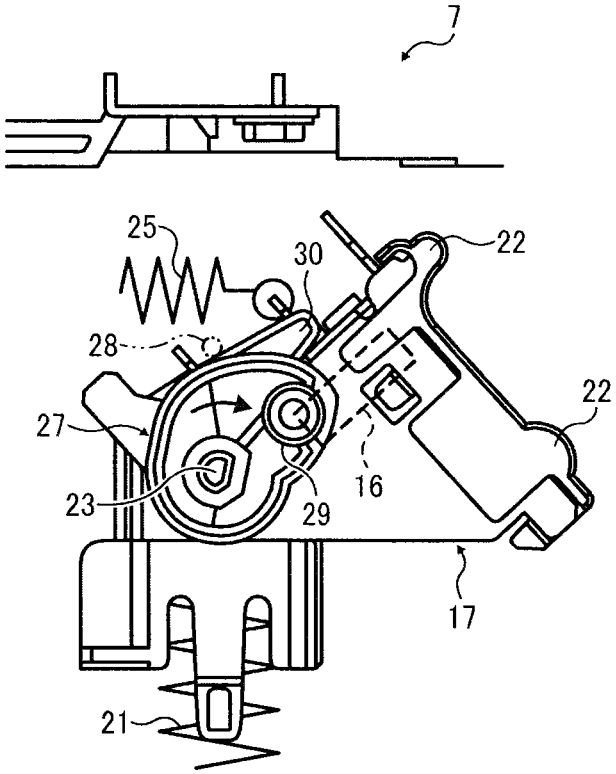
Figure 14:
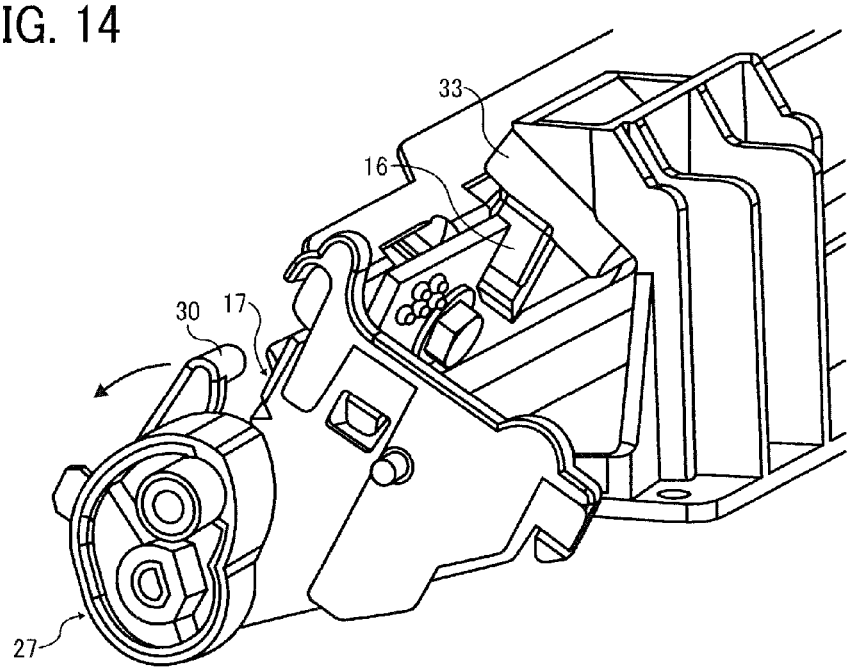
FIG. 14 is a schematic diagram illustrating a retainer in a state in which the retainer fails to follow rotation of the cam.

With reference to FIG. 13A through 13C, a description is provided of movement of the pattern detector 16 using the moving device assembly of FIG. 12. Basically, the movement of the pattern detector 16 is the same as that of the foregoing embodiment.

First, as illustrated in FIG. 13A, as the cover 101 is opened and the cam 27 rotates in the state in which the projections 22 of the retainer 17 are in contact with the bottom surface of the frame of the transfer device 7, the cam 27 slidably contacts the cam follower 28 as illustrated in FIG. 13B. Accordingly, the retainer 17 is pressed down, moving the pattern detectors 16 to the first retracted position at which the pattern detectors 16 are separated from the conveyor belt 8 in the direction perpendicular to the surface of the conveyor belt 8.

Subsequently, as illustrated in FIG. 13C, the cam 27 rotates and the tab 30 contacts the back of the retainer 17, pushing the retainer 17 in the rotation direction. As a result, the retainer 17 rotates about the shaft 23 in the clockwise direction in FIG. 13C and is held in the state in which the retainer 17 tilts forward. Accordingly, the pattern detector 16 is positioned at the second retracted position.

When closing the cover 101, the cam 27 and the retainer 17 operate in reverse order as to when the cover 101 is opened, returning from the state shown in FIG. 13C to the state shown in FIG. 13A.

It is to be noted that in the illustrative embodiment illustrated in FIG. 12, similar to the foregoing embodiment, the detection surface 16*a* of the pattern detector 16 is covered by the shield 40 as the pattern detector 16 is positioned at the second retracted position (shown in FIG. 9). Accordingly, the detection surface 16*a* is protected from contamination and damage. Furthermore, similar to the foregoing embodiment, the cleaning member 33 (shown in FIG. 10), the contamination detector 34, and the reporting device 35 (shown in FIG. 11) may be employed in the present illustrative embodiment.

Figure 15:
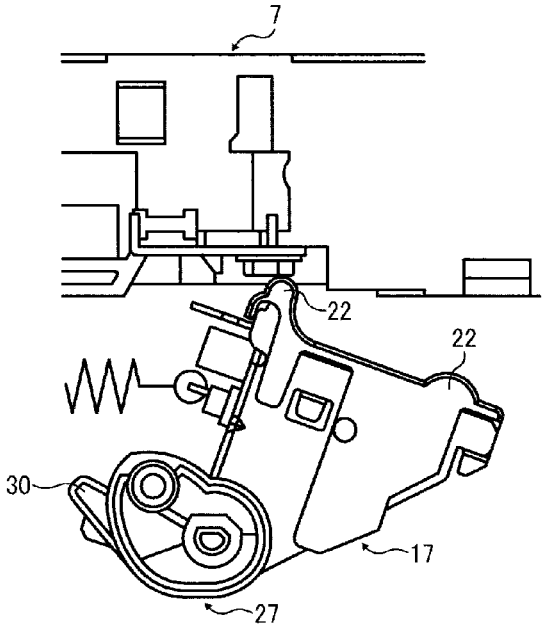
FIG. 15 is a schematic diagram illustrating the retainer in a state in which the retainer is misaligned.

According to the present illustrative embodiment, as the pattern detector 16 is returned to the detection position near the conveyor belt 8, the tension of the tension spring 25 causes the retainer 17 to rotate to follow rotation of the cam 27. However, if the retainer 17 is not rotated smoothly, the retainer 17 (contact target) separates from the tab 30 (contact member) and fails to follow rotation of the cam 27. More specifically, with the cleaning member 33, load generated by the pattern detector 16 slidably contacting the cleaning member 33 becomes resistance to the rotation of the retainer 17. Thus, the retainer 17 may fail to follow the rotation of the cam 27. In a case in which the retainer 17 does not return to the detection position at appropriate time, or the retainer 17 returns to the detection position late, as illustrated in FIG. 15, the retainer 17 contacts a different place other than the predetermined position and the position thereof is fixed. As a result, the pattern detector 16 is positioned out of the predetermined detection position.

In view of the above, the retainer 17 may be provided with an auxiliary member 41 to support returning movement of the retainer 17.

Figure 16:
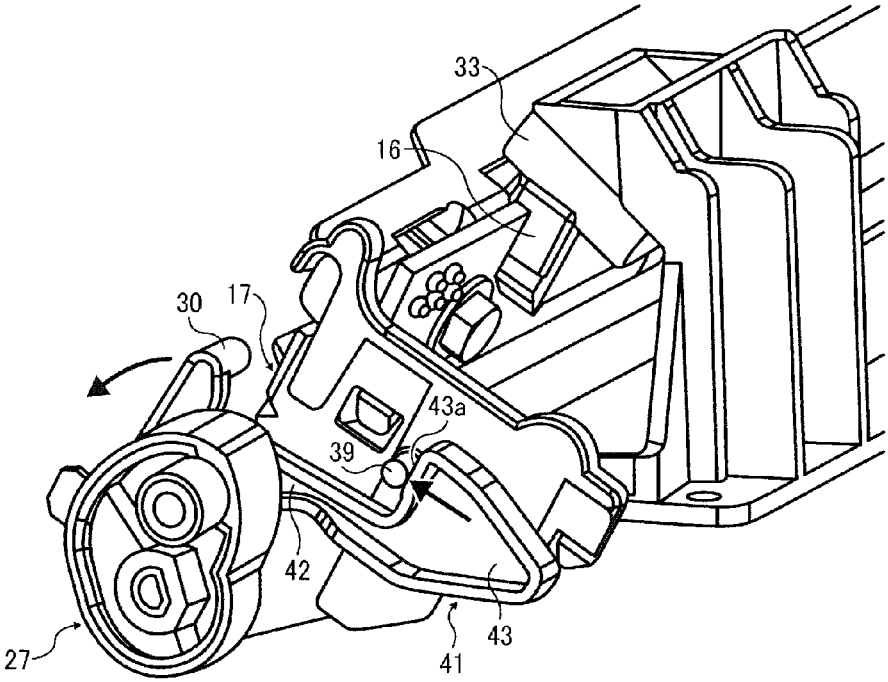
FIG. 16 is a schematic diagram illustrating a support member for supporting the movement of the retainer.

More specifically, as illustrated in FIG. 16, when returning the pattern detector 16 to the detection position (proximal position), the auxiliary member 41 contacts a projection 39 provided to the retainer 17 to support the retainer 17 to reliably return to the detection position. Alternatively, the auxiliary member 41 may contact other areas of the retainer 17, other than the projection 39, to support returning movement of the retainer 17.

Figure 17:
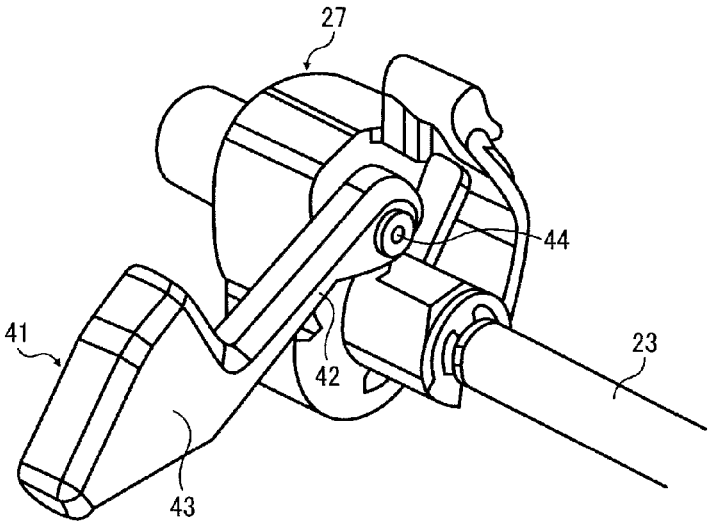
FIG. 17 is a schematic diagram illustrating a mounting structure of the support member of FIG. 16.
Figure 18A:
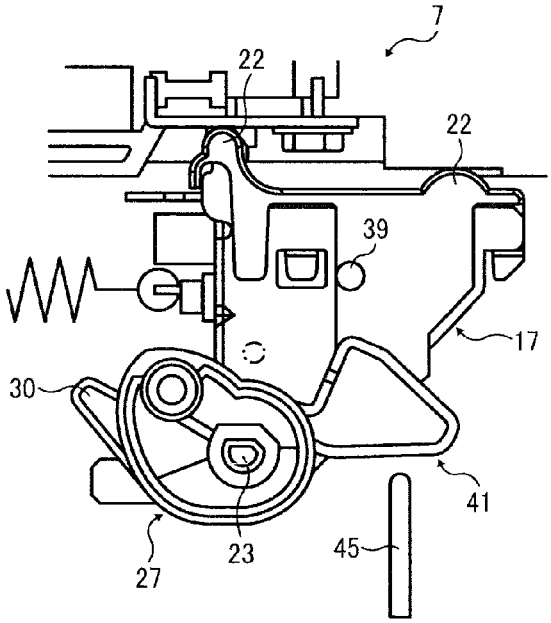
FIGS. 18A through 18D are schematic diagrams illustrating movement of the support member.
Figure 18B:
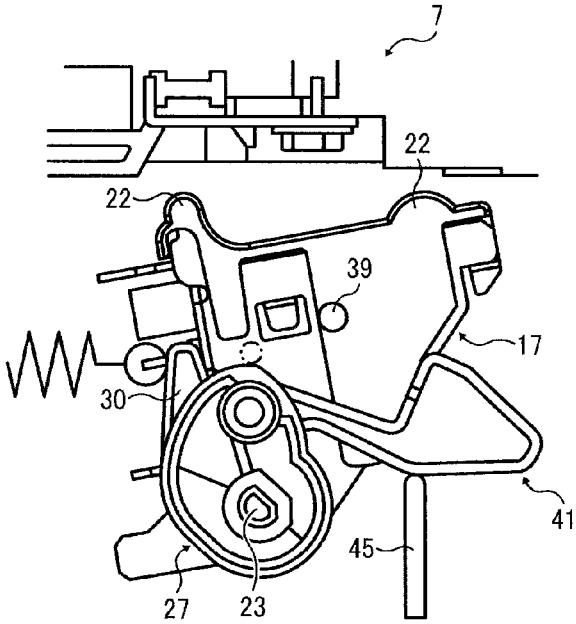
Figure 18C:
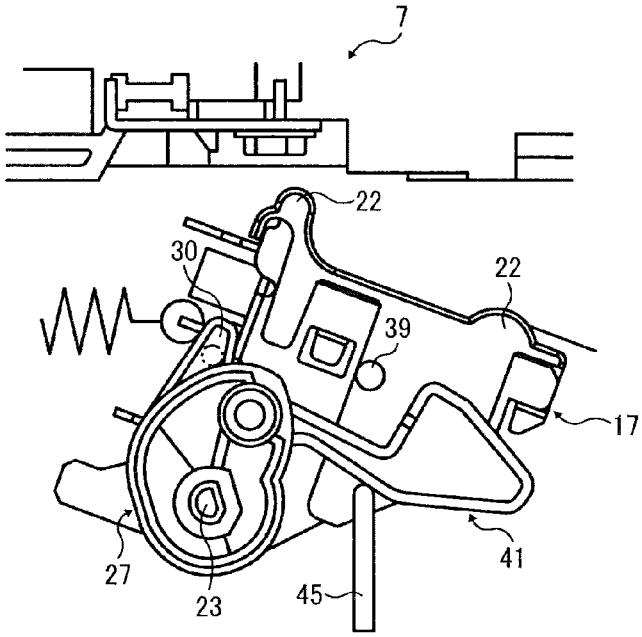
Figure 18D:
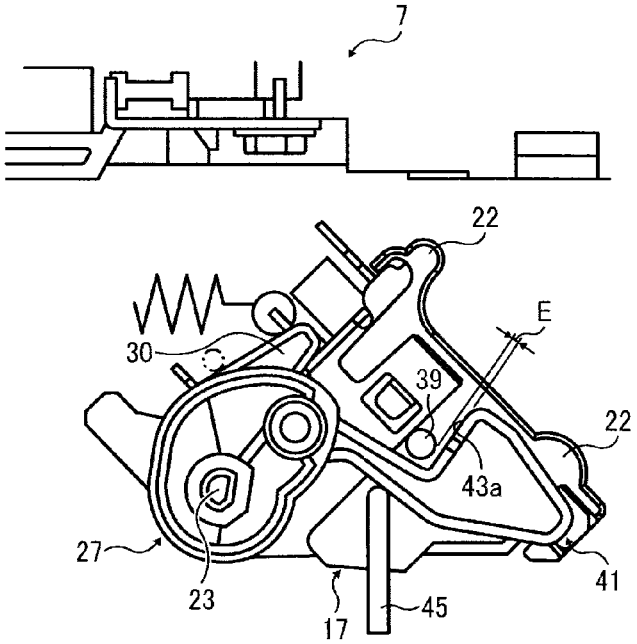

According to an illustrative embodiment illustrated in FIG. 16, the auxiliary member 41 includes an arm portion 42 and an engaging portion 43 including a contact surface 43*a*. The arm portion 42 extends from the cam 27. The engaging portion 43 is wedge-shaped and is formed substantially at a distal end of the arm portion 42 as a single integrated unit. The contact surface 43*a* of the engaging portion 43 contacts the projection 39. More specifically, as illustrated in FIG. 17, a proximal end of the arm member 42 of the auxiliary member 41, that is, the opposed end of the engaging portion 43, is pivotally attached to the cam 27 at a position different from the shaft 23. More specifically, the auxiliary member 41 is rotatable about a shaft 44.

With reference to FIGS. 18A through 18D, a description is provided of movement of the auxiliary member 41. FIGS. 18A through 18D are schematic diagrams illustrating the auxiliary member 41 at different positions.

As illustrated in FIGS. 18A through 18D, when moving the pattern detector 16 from the detection position (proximal position) to the second retracted position (the shield position), the cam 27 rotates in the clockwise direction, thereby moving the auxiliary member 41. In the meantime, the auxiliary member 41 is guided by a guide member 45 provided to the image forming apparatus main body. In this configuration, despite rotation of the cam 27, the direction of the auxiliary member 41 does not change significantly. In the state shown in FIG. 18A, the auxiliary member 41 is separated from the guide member 45, but contacts the shaft 23 connected to the cam 27. Accordingly, rotation of the auxiliary member 41 in the gravity direction is restricted, thereby keeping the auxiliary member 41 at a predetermined position.

When returning the pattern detector 16 from the second retracted position (shield position) to the detection position (proximal position), the auxiliary member 41 normally operates in reverse order as to when the pattern detector 16 moves from the detection position to the second retraction position described above.

In a case in which the retainer 17 fails to follow the rotation of the cam 27 and there is a delay in the returning movement of the retainer 17 when returning the pattern detector 16 to the detection position (proximal position), the contact surface 43*a* of the auxiliary member 41 contacts the projection 39 as illustrated in FIG. 16. In other words, in the state shown in FIG. 18D, the contact surface 43*a* is spaced apart a certain distance (i.e., a distance E) from the projection 39.

In a case in which the tab 30 separates from the contact target of the retainer 17 while the pattern detector 16 returns to the detection position (proximal position), the auxiliary member 41 contacts the projection 39. Consequently, the engaging portion 43 of the auxiliary member 41 is hooked to the projection 39, and the auxiliary member 41 is pulled as the cam 27 rotates, pushing the projection 39 in the direction in which the pattern detector 16 is returned to the detection position (proximal position). As a result, the retainer 17 follows rotation of the cam 27 and successfully contacts the desired position of the transfer device 7.

According to the illustrative embodiments described above, the detection surface of the pattern detector is covered and protected from contamination and damage by moving the pattern detector to the shield position. Hence, optimum detection accuracy of the pattern detector 16 can be maintained reliably, thereby preventing degradation of image quality.

According to the illustrative embodiments described above, the cleaning member is provided to clean the detection surface of the pattern detector. With this configuration, the detection surface is cleaned when the detection surface is contaminated, thereby maintaining optimum detection accuracy as well.

Furthermore, according to the illustrative embodiments, the operation associated with moving the pattern detector to the shield position (opening the cover) can move the pattern detector to the cleaning potion at which the detection surface of the pattern detector is cleaned by the cleaning member. In other words, a single operation can enable the pattern detector to be covered and cleaned, thereby enhancing operability. Because covering and cleaning of the detection surface requires only a single operation, downsizing and cost reduction can be achieved.

According to the illustrative embodiments described above, the cover provided to the frame of the image forming apparatus serves as an operation device for moving the pattern detector, hence requiring no additional operation device for moving the pattern detector. Simplification, downsizing, and cost reduction of the image forming apparatus are achieved, which are desired for the apparatus. Opening the cover 101 enables the pattern detector 16 to retract automatically from the transfer device 7 so that upon replacement of the transfer device 7, the pattern detector 16 is prevented from staying at the detection position. With this configuration, the pattern detector is prevented from getting damaged upon replacement of the transfer device reliably.

It is to be noted that the operation device for moving the pattern detector is not limited to the cover. For example, the operation device may include a movable lever that moves between a first position and a second position. The lever at the first position, for example, may bring the pattern detector to the detection position (proximal position), and the lever at the second position brings the pattern detector to the retracted position (shield position).

According to the illustrative embodiments, the moving device assembly is applied to the pattern detector for detecting the image patterns on the conveyor belt that delivers a recording medium. The moving device assembly may be applied to other devices such as a detector disposed opposite a rotary member including, but not limited to, an intermediate transfer belt and a photosensitive drum to detect image patterns formed thereon.

Figure 19:
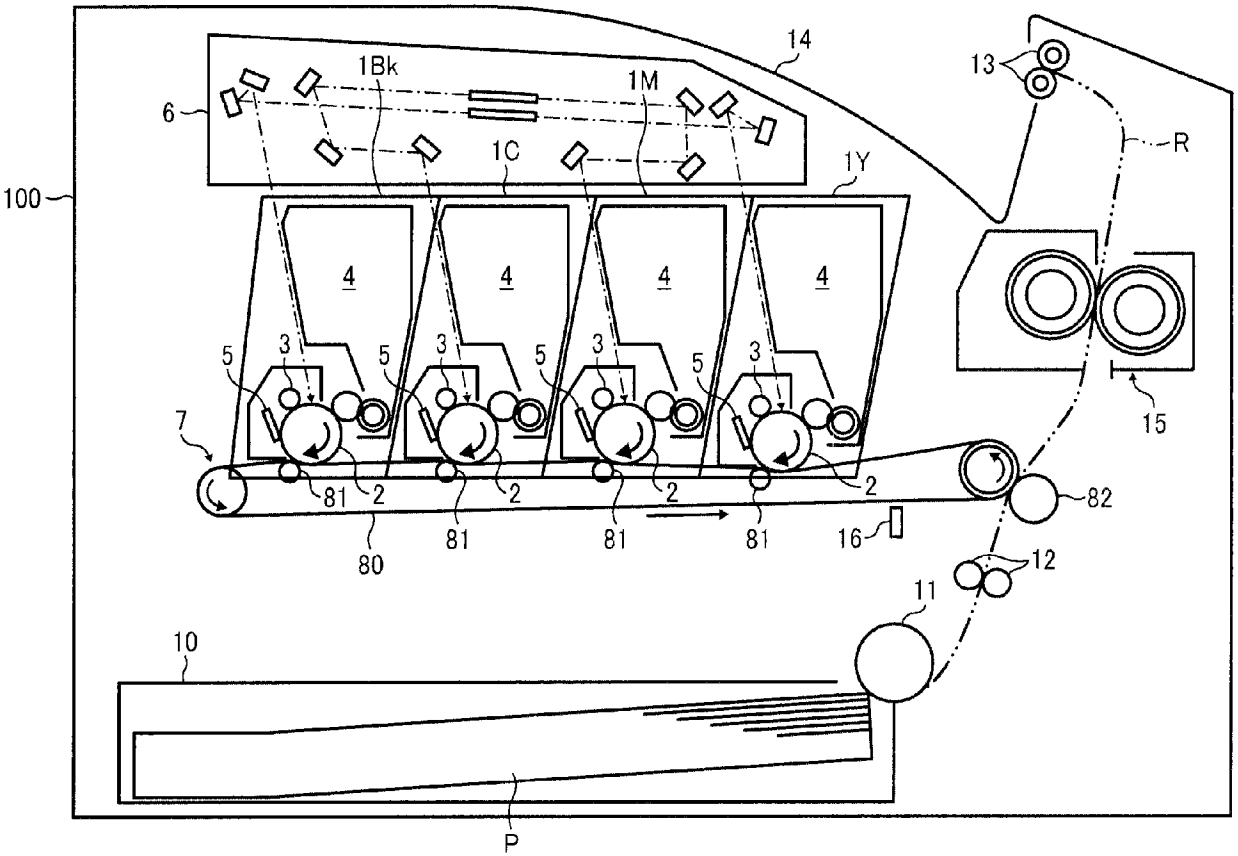
FIG. 19 is a schematic diagram illustrating an image forming apparatus equipped with an intermediate transfer belt on which image patterns are formed and detected by the detector.
Figure 20:
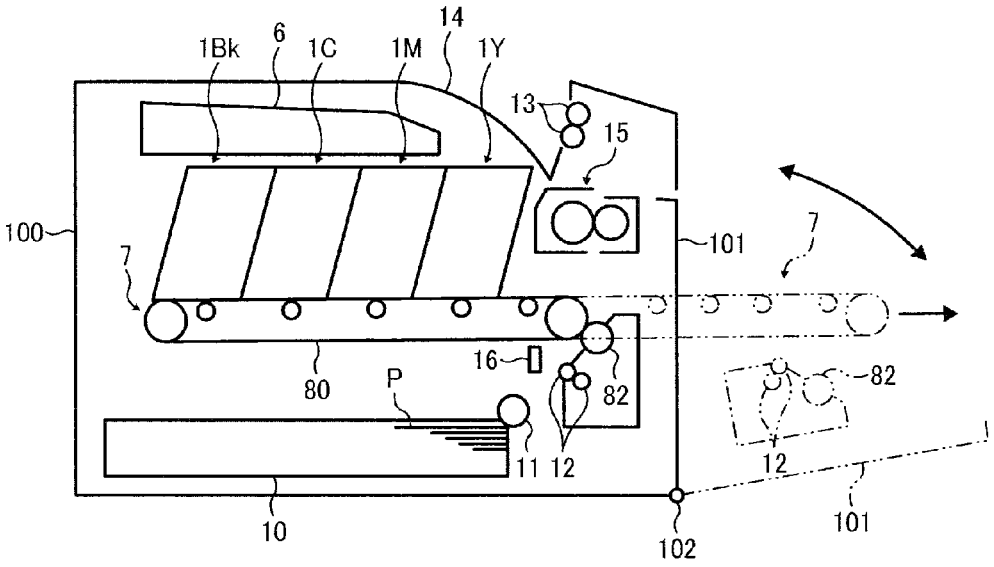
FIG. 20 is a schematic diagram illustrating a detachably attachable transfer device relative to a frame of the image forming apparatus.

With reference to FIGS. 19 and 20, a description is provided of an image forming apparatus in which the pattern detector 16 is disposed opposite an intermediate transfer belt 80 on which image patterns are formed, according to another illustrative embodiment of the present disclosure. FIG. 19 is a schematic diagram illustrating the image forming apparatus equipped with the intermediate transfer belt 80. FIG. 20 is a schematic diagram illustrating the transfer device 7 being removed from the image forming apparatus of FIG. 19.

According to the present illustrative embodiment illustrated in FIG. 19, toner images on the photosensitive drums 2 in each of the image forming units 1Y, 1M, 1C, and 1Bk are transferred onto the intermediate transfer belt 80 opposite primary transfer rollers 81 such that they are superimposed one atop the other, thereby forming a composite toner image on the intermediate transfer belt 80 in the process known as a primary transfer process. Subsequently, the composite toner image on the intermediate transfer belt 80 is transferred onto a recording medium at a position opposite a secondary transfer roller 82 in the process known as a secondary transfer process.

The recording medium is fed from the sheet tray 10 by the sheet feed roller 11. In FIG. 19, the same reference numerals used in the foregoing embodiments will be given to constituent elements such as parts and materials having the same functions, and the descriptions thereof will be omitted.

According to the present illustrative embodiment, when adjusting the density and the position of an image, similar to the foregoing embodiments, image patterns are formed on the photosensitive drums 2 of the image forming units 1Y, 1M, 1C, and 1Bk, and then transferred onto the intermediate transfer belt 80 across from each of the primary transfer rollers 81. As the intermediate transfer belt 80 rotates and the image patterns formed on the intermediate transfer belt 80 arrive at a position across from the pattern detector 16, the pattern detector 16 detects the image patterns, and the position and the density thereof are adjusted based on the detection result provided by the pattern detector 16.

As illustrated in FIG. 20, according to the present illustrative embodiment, the cover 101 is provided to the front (the right hand side in FIG. 20) of the image forming apparatus 100 and pivotally movable about the fulcrum 102. With the cover 101 opened as indicated by a broken line in FIG. 20, the secondary transfer roller 82, the pair of registration rollers 12, and so forth separate from the front of the intermediate transfer belt 80 together with the cover 101, thereby allowing the transfer device 7 including the intermediate transfer belt 80, the primary transfer rollers 81, and so forth to move in the horizontal direction and be removed from the image forming apparatus.

The moving device assembly of the present disclosure can be applied to the image forming apparatus described above, and the moving device assembly can move the pattern detector to the shield position, thereby preventing contamination of and damage to the detection surface of the pattern detector and hence maintaining an optimum detection accuracy of the pattern detector.

In addition to detecting the image pattern on the intermediate transfer belt and the conveyor belt, the pattern detector may detect abrasion of the surface of the intermediate transfer belt and the conveyor belt, or the surface of abrasion of the rotary member such as the photosensitive drums.

The moving device assembly of the present disclosure may be used to separate a detector including a detection surface from an opposing member different from the above-described rotary member. The detector to be separated from the opposing member by the moving device assembly of the illustrative embodiments may be disposed such that the detector does not contact the opposing member when the detector is at the proximal position relative to the opposing member.

According to an aspect of the disclosure, a moving device assembly (e.g., the moving device assembly 200) includes a moving device (e.g., the cover 101) and a shield (the shield 40). The moving device is movable between a first position and a second position, to move a detector (e.g., the detector 16) including a detection surface relative to an opposing member (e.g., the conveyor belt 8). The shield shields the detection surface of the detector. In a case in which the moving device is at the first position, the detector is at a proximal position at which the detector is near the opposing member, and as the moving device is at the second position, the detector is at a shield position at which the detector is separated from the opposing member and the detection surface of the detector is shielded by the shield.

According to an aspect of the disclosure, the moving device assembly includes a retainer (e.g., the retainer 17), a cam follower (e.g., the cam follower 28), a cam (e.g., the cam 27), a contact member (e.g., the tab 30), and a biasing member (e.g., the compression spring 21). The retainer includes a contact target (e.g., the projection 31) to hold the detector. The retainer is rotatably supported by a shaft (e.g., the shaft 23) and movable relative to the opposing member. The cam follower is fixed to a component (e.g., the frame of the image forming apparatus) other than the retainer. The cam is rotated by the moving device to slidably contact the cam follower so as to separate the retainer from the opposing member and move the detector to the shield position. The contact member rotates together with the cam and contacts the contact target to rotate the retainer to move the detector to the shield position. The biasing member biases the retainer to move the detector to the proximal position.

According to an aspect of the disclosure, the cam includes a first cam surface (e.g., the first cam surface 27*a*) and a second cam surface (e.g., the second cam surface 27*b*) continuously formed with the first cam surface. A distance between a center (the center Q) of rotation of the cam and the first cam surface increases gradually.

According to an aspect of the disclosure, the cam (e.g., the cam 27) and the retainer (e.g., the retainer 17) are connected via the shaft (e.g., the shaft 23), and the cam and the retainer are rotatable about the shaft.

According to an aspect of the disclosure, the moving device assembly includes also a retainer guide (e.g., the pair of guide members 32) that guides the retainer in directions in which the retainer approaches and separates from the opposing member.

According to an aspect of the disclosure, the moving device assembly includes also a belt support (the belt support 20). The opposing member includes a belt formed into an endless loop, and a surface thereof opposite a surface facing the detector is supported by the belt support. The biasing member biases the retainer against the belt support.

According to an aspect of the disclosure, the moving device assembly includes also an auxiliary member (e.g., the auxiliary member 41) to pressingly contact the retainer to move the detector to the proximal position upon moving the detector to the proximal position.

According to an aspect of the disclosure, the moving device assembly includes an auxiliary member guide (e.g., the guide member 45) to guide the auxiliary member. The auxiliary member moves in conjunction with rotation of the cam, and the auxiliary member guide guides the auxiliary member as the auxiliary member moves.

According to an aspect of the disclosure, while the contact member (e.g., the tab 30) is in contact with the contact target (e.g., the projection 31) of the retainer (e.g., the retainer 17), a contact surface (e.g., the contact surface 43*a*) of the auxiliary member that contacts the retainer is spaced apart a certain distance (e.g., the distance E) from the retainer. When the contact member separates from the contact target of the retainer while the detector is moved to the proximal position, the auxiliary member pressingly contacts the retainer.

According to an aspect of the disclosure, the moving member includes an openable cover (e.g., the cover 101) that covers a housing of an image forming apparatus (e.g., the image forming apparatus 100). When opening the cover, the detector is moved from the proximal position to the shield position, and when closing the cover, the detector is moved from the shield position to the proximal position.

According to an aspect of the disclosure, the moving device assembly includes a cleaning device (e.g., the cleaning device 33) to clean the detection surface of the detector. While the moving device is at the second position, the detector is at the shield position and the cleaning device cleans the detection surface of the detector. The cleaning device is formed of a material that charges the detector to the same polarity as that of toner by contacting the detector.

According to an aspect of the disclosure, the moving device assembly includes a contamination detector (e.g., the contamination detector 34) to detect contamination of the detection surface of the detector, and a reporting device (e.g., the reporting device 35) to report contamination detected by the contamination detector.

According to an aspect of the disclosure, an image forming apparatus (e.g., the image forming apparatus 100) includes the moving device assembly (e.g., the moving device assembly 200).

The image forming apparatus includes, but is not limited to, an electrophotographic image forming apparatus, an inkjet image forming apparatus, and any other types of image forming apparatuses.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A moving device assembly, comprising:

a moving device movable between a first position and a second position, to move a detector including a detection surface relative to an opposing member disposed opposite the detector; and a shield to shield the detection surface of the detector, wherein as the moving device is at the first position, the detector is at a proximal position at which the detector is near the opposing member, and as the moving device is at the second position, the detector is at a shield position at which the detector is separated from the opposing member and the detection surface of the detector is shielded by the shield.

2. The moving device assembly according to claim 1, further comprising:

a retainer including a contact target to hold the detector, the retainer rotatably supported by a shaft and movable relative to the opposing member and;

a cam follower fixed to a component other than the retainer;

a cam rotated by the moving device to slidably contact the cam follower so as to separate the retainer from the opposing member and move the detector to the shield position;

a contact member to rotate together with the cam and contact the contact target to rotate the retainer to move the detector to the shield position; and a biasing member to bias the retainer to move the detector to the proximal position.

3. The moving device assembly according to claim 2, wherein the cam comprises a first cam surface and a second cam surface continuously formed with the first cam surface;

wherein a distance between a center of rotation of the cam and the first cam surface increases gradually.

4. The moving device assembly according to claim 2, wherein the cam and the retainer are connected via the shaft, and the cam and the retainer are rotatable about the shaft.

5. The moving device assembly according to claim 2, further comprising a retainer guide that guides the retainer in directions in which the retainer approaches and separates from the opposing member.

6. The moving device assembly according to claim 2, further comprising a belt support, wherein the opposing member includes a belt formed into an endless loop, and a surface thereof opposite a surface facing the detector is supported by the belt support;

wherein the biasing member biases the retainer against the belt support.

7. The moving device assembly according to claim 2, further comprising an auxiliary member to pressingly contact the retainer to move the detector to the proximal position upon moving the detector to the proximal position.

8. The moving device assembly according to claim 7, further comprising an auxiliary member guide to guide the auxiliary member, wherein the auxiliary member moves in conjunction with rotation of the cam, and the auxiliary member guide guides the auxiliary member as the auxiliary member moves.

9. The moving device assembly according to claim 7, wherein while the contact member is in contact with the contact target of the retainer, a contact surface of the auxiliary member that contacts the retainer is spaced apart a certain distance from the retainer, wherein as the contact member separates from the contact target of the retainer while the detector is moved to the proximal position, the auxiliary member pressingly contacts the retainer.

10. The moving device assembly according to claim 1, wherein the moving device includes an openable cover that covers a housing of an image forming apparatus, wherein, upon opening the cover, the detector is moved from the proximal position to the shield position, and upon closing the cover, the detector is moved from the shield position to the proximal position.

11. The moving device assembly according to claim 1, further comprising a cleaning device to clean the detection surface of the detector, wherein while the moving device is at the second position, the detector is at the shield position and the cleaning device cleans the detection surface of the detector.

12. The moving device assembly according to claim 11, wherein the cleaning device is formed of a material that charges the detector to the same polarity as that of toner by contacting the detector.

13. The moving device assembly according to claim 11, further comprising:

a contamination detector to detect contamination of the detection surface of the detector; and a reporting device to report contamination detected by the contamination detector.

14. An image forming apparatus, comprising the moving device assembly according to claim 1.

15. A moving device assembly, comprising:

a moving device movable between a first position and a second position, to move a detector including a detection surface relative to an opposing member disposed opposite the detector;

a shaft, and a shield to shield the detection surface of the detector, wherein as the moving device is moved from the first position to the second position, the detector is moved from a proximal position at which the detector is near the opposing member to a first retracted position at which the detector is separated from the opposing member and to a second retracted position at which the detector is separated from the opposing member and the detection surface of the detector is shielded by the shield by rotating the detector about the shaft.

16. The moving device assembly according to claim 15, wherein the moving device includes an openable cover that covers a housing of an image forming apparatus, wherein, as the cover is opened, the detector is moved from the proximal position at which the detector is near the opposing member to the first retracted position at which the detector is separated from the opposing member and to the second retracted position at which the detector is separated from the opposing member and the detection surface of the detector is shielded by the shield by rotating the detector about the shaft.

17. An image forming apparatus, comprising the moving device assembly according to claim 15.

18. A moving device assembly, comprising:

a moving device movable between a first position and a second position, to move a first member including a detection surface relative to a second member disposed opposite the first member; and a shield to shield the detection surface of the first member, wherein as the moving device is at the first position, the first member is at a proximal position at which the first member is near the second member, and as the moving device is at the second position, the first member is at a shield position at which the first member is separated from the second member and the detection surface of the first member is shielded by the shield.

19. An image forming apparatus, comprising the moving device assembly according to claim 18.

* * * * *